US012467216B2

(12) United States Patent
Niederer

(10) Patent No.: US 12,467,216 B2
(45) Date of Patent: Nov. 11, 2025

(54) APPARATUS FOR CONVEYING AND DISCHARGING BULK MATERIAL OR SNOW

(71) Applicant: BWM technologies GmbH, Linz (AT)

(72) Inventor: Hermann Niederer, Scheibbs (AT)

( * ) Notice: Subject to any disclaimer, the term of this patent is extended or adjusted under 35 U.S.C. 154(b) by 974 days.

(21) Appl. No.: 17/606,207

(22) PCT Filed: Jun. 23, 2020

(86) PCT No.: PCT/IB2020/055901
§ 371 (c)(1),
(2) Date: Oct. 25, 2021

(87) PCT Pub. No.: WO2020/217239
PCT Pub. Date: Oct. 29, 2020

(65) Prior Publication Data

US 2022/0195681 A1 Jun. 23, 2022

(30) Foreign Application Priority Data

Apr. 25, 2019 (AT) ..... A 145/2019

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01)

(58) Field of Classification Search
CPC ..... E01H 5/098; E01H 5/045
See application file for complete search history.

(56) References Cited

U.S. PATENT DOCUMENTS 2,735,199 A * 2/1956 Wanner et al. ..... E01H 5/045 37/243
3,805,421 A * 4/1974 Kamlukin ..... E01H 5/045 56/294

(Continued)

FOREIGN PATENT DOCUMENTS

AT 503406 B1 11/2009
AT 506767 A1 11/2009

(Continued)

OTHER PUBLICATIONS

English-language Abstract for DE 19544208 C1, May 7, 1997.

*Primary Examiner* — Jamie L McGowan
(74) *Attorney, Agent, or Firm* — Tiajoloff & Kelly LLP

(57) ABSTRACT

In an apparatus for conveying and discharging bulk material or snow, comprising at least one conveying device which has a tubular, circumferentially partially open conveying housing (1) and the conveying direction of which extends substantially in the direction of the tube axis (5), and comprising at least one centrifugal ejector, adjoining the at least one conveying device in the conveying direction and having at least one centrifugal wheel (8), which has at least one discharge lever (9), is arranged in a centrifugal-wheel housing (11) having a discharge opening (14) and can be driven to rotate about an axis of rotation (12), the conveying housing (1) has a smaller diameter than the ejector wheel (8) and the tube axis (5) is arranged parallel under the axis of rotation (12) of the ejector wheel (8), at a vertical normal distance.

12 Claims, 6 Drawing Sheets

(56) References Cited

U.S. PATENT DOCUMENTS

Figure 1:
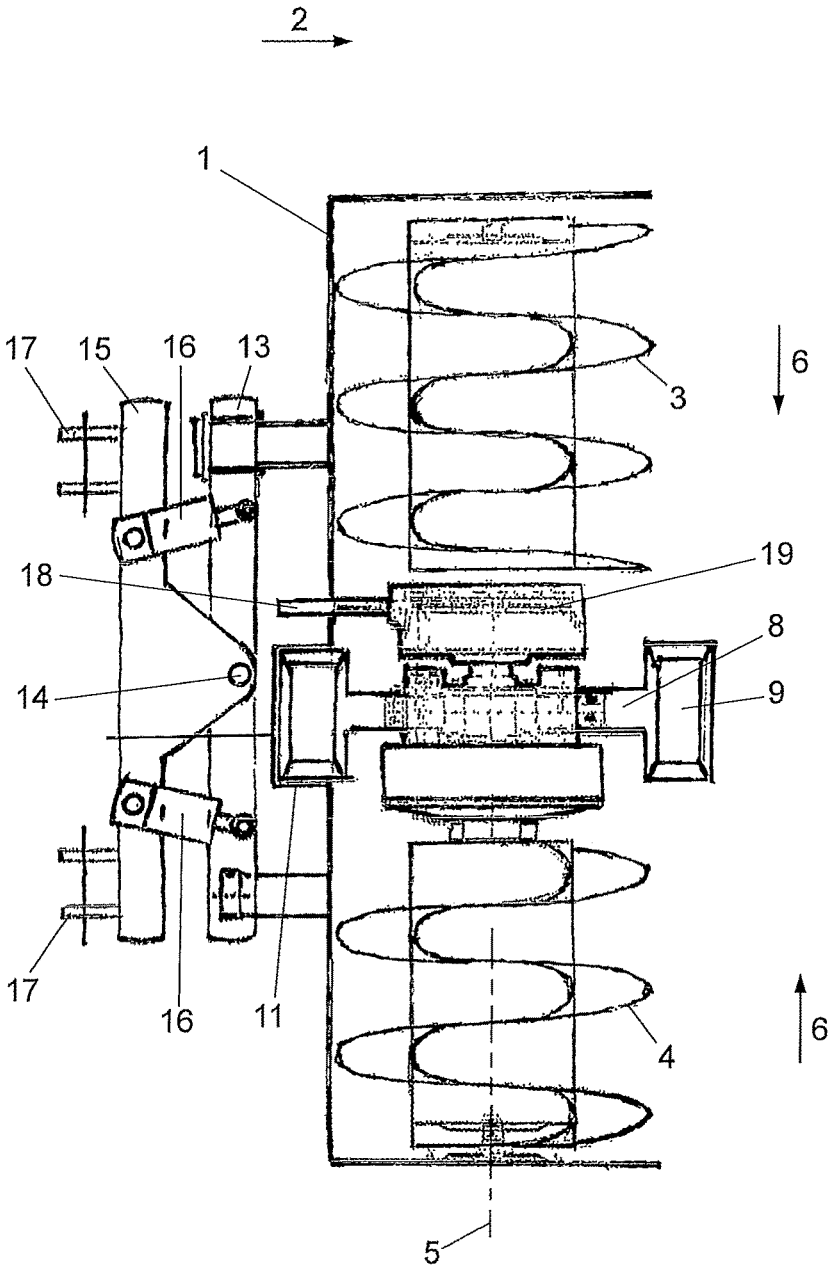

| | | | | | |
|---|---|---|---|---|---|
| 4,158,923 | A * | 6/1979 | Steiner | E01H 5/045 | 193/2 A |
| 4,367,603 | A * | 1/1983 | Schlapman | E01H 5/045 | 37/251 |
| 4,385,457 | A * | 5/1983 | Fralish | E01H 5/098 | 37/259 |
| 4,951,403 | A * | 8/1990 | Olmr | E01H 5/04 | 37/244 |
| 5,101,585 | A * | 4/1992 | Gerbrandt | E01H 5/098 | 37/249 |
| 5,163,239 | A * | 11/1992 | Lampe | E01H 5/045 | 37/260 |
| 7,770,716 | B2 * | 8/2010 | Niederer | E04C 5/064 | 198/642 |
| 2002/0178622 | A1 * | 12/2002 | Loegering | E01H 5/098 | 37/244 |
| 2009/0173600 | A1 * | 7/2009 | Niederer | E01H 5/098 | 198/642 |
| 2011/0239491 | A1 * | 10/2011 | Chen | E01H 5/045 | 37/253 |
| 2014/0237864 | A1 * | 8/2014 | Gilpatrick | E01H 5/045 | 37/259 |
| 2021/0095433 | A1 * | 4/2021 | Landry | E01H 5/045 | |
| 2021/0277616 | A1 * | 9/2021 | Girouard | E01H 5/045 | |

FOREIGN PATENT DOCUMENTS

| | | | | | |
|---|---|---|---|---|---|
| AT | 506767 | B1 | | 8/2010 | |
| AT | 102012202876 | A1 | | 8/2013 | |
| DE | 19544208 | C1 | | 5/1997 | |
| DE | 102012202876 | B4 | | 9/2014 | |
| WO | WO-2007115345 | A1 | * | 10/2007 | E01H 5/045 |

* cited by examiner

APPARATUS FOR CONVEYING AND DISCHARGING BULK MATERIAL OR SNOW

The application relates to an apparatus for conveying and discharging bulk material or snow, comprising at least one conveying device having a tubular conveying housing which is partially open at the circumference and the conveying direction of which extends substantially in the direction of the tube axis, and comprising at least one centrifugal ejector which adjoins the at least one conveying device in the conveying direction and has an ejector wheel which has at least one discharge lever, is arranged in an ejector wheel housing having an discharge opening and can be driven to rotate about an axis of rotation.

Apparatuses for conveying and discharging bulk material or snow are used in a wide variety of applications. In particular in the agricultural and forestry sector, the use of centrifugal ejectors for harvesting machines, debarking devices and the like is known. In addition to such independent apparatuses, additional apparatuses are also known which can be coupled to tractors and other agricultural machines so that they are driven by their engine. In this connection, for example, snow blowers have become known which are coupled to tractors or small excavators.

Snow blowers generally have a conveyor comprising, for example, a cutter drum which is mounted in front of the vehicle and whose axis extends parallel to the vehicle axis. On the drum, which usually extends over the entire width of the vehicle, blades are arranged in the shape of a screw, which serve both for scraping off the snow, for which purpose the blades may also be provided with a saw-tooth profile, and for transporting it to a snow ejector. If the snow ejector is mounted in the middle of the cutter drum, the screw of the blades is formed in two parts with opposite chirality. The transport in the horizontal works as in an Archimedean screw, so that the snow, which is cut off over the entire width of the drum, is transported to the center. There the snow ejector is arranged, which ejects the snow conveyed to the center. The snow ejector can here be formed by a centrifugal ejector which, as mentioned at the beginning, comprises an ejector wheel having at least one discharge lever. The ejection rate is naturally dependent on the circumferential speed of the ejector wheel or the individual discharge levers and, in particular, on the applied torque.

An apparatus of the type mentioned above for conveying and discharging bulk material or snow is known, for example, from AT 503406 B1.

As described in AT 503406 B1, the rotational speed provided at the output shaft of an agricultural implement, and in particular of a tractor, usually has to be reduced to a lower rotational speed by means of a reduction gear in order to achieve a rotational speed suitable for coupling a centrifugal ejector, and in particular a snow blower. For example, in known snow blowers it was common practice to reduce the speed provided by the output shaft of the tractor from 2200 rpm to 1100 rpm so that the torque provided by the output shaft could be doubled for the centrifugal ejector of the snow blower. However, a further reduction and thus a further increase in torque was not possible with the known centrifugal ejectors because the required ejection performance could no longer be guaranteed due to the resulting further reduction in the number of revolutions.

In order to provide a centrifugal ejector with increased ejection performance under the same drive conditions, AT 503406 B1 discloses a centrifugal ejector in which at least one discharge lever is pivotably fixed to the ejector wheel and means are provided for defined variation of the pivot angle of the discharge lever as a function of the angle of rotation of the ejector wheel. As a result of the fact that the discharge lever is pivotably fixed to the ejector wheel, the circumferential speed of the discharge lever can be increased when the discharge lever is pivoted accordingly, while the rotational speed of the ejector wheel remains constant, so that the ejection performance is improved. In particular, a pivoting of the discharge lever in the direction of rotation is effected over a first angle of rotation range, and a pivoting of the discharge lever counter to the direction of rotation of the ejector wheel is effected over a further angle of rotation range. With such a control of the pivoting movement of the individual discharge levers, an increasing circumferential speed of the discharge levers is achieved over the first angle of rotation range, and a decreasing circumferential speed of the discharge levers is again achieved when the further angle of rotation range is passed over.

The present invention now aims at further designing an apparatus of the type mentioned at the beginning, in such a way that the ejection capacity is increased and/or the drive power required for driving the conveying device and/or the ejector wheel is reduced.

In order to solve this problem, the invention essentially provides, in an apparatus of the type mentioned above, that the conveying housing has a smaller diameter than the ejector wheel and that the tube axis is arranged at a vertical normal distance parallel below the axis of rotation of the ejector wheel.

The design according to the invention results in the conveying housing overlapping the ejector wheel or its capture area only in a lower area as seen in the axial direction, so that the material is only fed into a corresponding partial area of the capture area of the ejector wheel. In the upper area of the ejector wheel, which does not overlap with the conveying housing in the axial direction, the ejector wheel does not come into contact with the material being conveyed, so that no resistance is offered to the discharge levers in this area. In the overlapping area, the material directly enters a circumferential section of the ejector wheel, in which the latter accelerates the material in the circumferential direction and subsequently ejects it upwards.

The power provided by the drive can thus be used almost completely for the actual ejection of the material. This means that the drive power can be reduced for the same ejection performance or the ejection performance can be increased for the same drive power.

Preferably, the discharge opening is tangentially connected to the ejector wheel, in particular to an area of the ejector wheel where the discharge levers accelerate the material upwardly from a ground level in a receiving manner. Preferably, a tangential ejection tube is connected to the ejector wheel housing, in particular directed substantially vertically upwards.

In order to prevent lateral penetration of material coming from the conveying device into the region of the ejector wheel, in which the material is accelerated upwards from a ground plane and then ejected via the tangential discharge opening, a partition wall is preferably provided between the ejector wheel and the conveying device. In this case, the partition wall preferably extends perpendicularly to the axis of rotation of the ejector wheel and forms a lateral boundary of an ejection channel arranged immediately in front of the discharge opening in the direction of rotation of the ejector wheel.

Preferably, the partition wall extends over a cross-sectional area of the centrifugal ejector that is aligned with the ejection tube, as viewed in the axial direction.

Preferably, a partition wall is arranged on each side of the ejector wheel so that the ejection channel is bounded on both sides by the partition walls.

Preferably, the ejector wheel housing is formed by an axial portion of the tubular conveying housing formed with an enlarged diameter. In particular, the enlarged diameter results in an annular housing extension. Thereby, the cheeks formed at the diameter extension of the tubular conveying housing can form the at least one partition wall or a partial area thereof.

According to a preferred design, it is provided that the enveloping circles of the ejector wheel and the conveying housing have a common tangent, which preferably extends parallel to the ground or horizontally. The vertical offset between the tube axis of the conveying housing and the axis of rotation of the ejector wheel is therefore such that the conveying housing and the enveloping circle of the ejector wheel touch the same plane at the bottom, which is preferably the ground plane from which the material is gripped by means of the conveying device. For gripping the material, the conveying housing is open in the peripheral region facing the ground plane.

Preferably, the axis of rotation of the ejector wheel and the tube axis of the conveying housing lie on a substantially vertical straight line.

The diameter of the conveying housing is preferably dimensioned to correspond to at least 50%, preferably at least 60%, preferably at least 65%, of the diameter of the ejector wheel. Upwardly, the diameter of the conveying housing is preferably limited such that it corresponds to less than 80%, preferably less than 75%, of the diameter of the ejector wheel.

A particularly efficient conveying in the axial direction of the conveying tube is achieved according to a preferred design in that the conveying device is designed in the form of a conveying spiral or screw.

In order to enable the material to be fed from both sides of the ejector wheel, it is preferably provided that a conveying device, in particular a conveying spiral or screw conveyor, is arranged on each side of the ejector wheel and has a tubular conveying housing which is partially open at the circumference, the conveying direction of which conveying device extends substantially in the axial direction of the tube towards the ejector wheel.

An optimization of the ejection performance is achieved, as is known per se, in that the at least one discharge lever is pivotably fixed to the ejector wheel and means are provided for the defined variation of the pivot angle of the discharge lever as a function of the angle of rotation of the ejector wheel. In particular, the means are designed to effect a pivoting of the discharge lever in the direction of rotation over a first angle of rotation range ($\alpha$) and a pivoting of the discharge lever counter to the direction of rotation of the ejector wheel over a further angle of rotation range ($\beta$).

It is advantageously provided that the discharge opening at the end of the first angle of rotation range is tangentially connected to the ejector wheel, i.e. at a point at which the circumferential speed of the respective discharge lever is greatest, so that the material to be ejected is ejected at a correspondingly higher speed.

Overall, the described acceleration of the discharge levers in the aforementioned rotation angle range means that the rotational speed of the ejector wheel can be selected lower than in conventional designs, since the circumferential speed of the discharge levers does not result from the rotational speed of the ejector wheel alone, but can be increased to the required level by the additional pivoting of the discharge levers described above. Thus, for example, when coupling the centrifugal ejector to an output shaft of a tractor rotating at a speed of 2200 rpm, a reduction of up to four times is possible, i.e. to a speed of 540 rpm. This now results in a quadrupling of the torque, so that the ejection performance of the centrifugal ejector can be increased accordingly. Due to the higher torque, it is possible, for example, to arrange a smaller number of discharge levers on the ejector wheel, so that a higher filling degree is achieved overall and larger quantities of material can be ejected in the time unit.

According to a preferred embodiment, a particularly simple control of the discharge lever pivoting is achieved in that the at least one discharge lever is designed as a two-armed lever, wherein the inwardly extending lever arm cooperates with a positive guide. In this case, the positive guide can comprise a guide track which interacts with a guide pin of the lever arm. In this case, a construction associated with particularly low frictional losses is of particular advantage, in which the guide track extends eccentrically to the axis of rotation of the ejector wheel. A further advantage of such a construction is that the adjustment of the extent of the eccentricity makes it possible to influence the change in the pivoting angle of the discharge lever in a simple manner.

As already mentioned, a particularly preferred field of application of the centrifugal ejector according to the invention is in snow blowers, and it is therefore advantageously provided that the ejector wheel is connected to a conveying spiral or screw of a snow blower.

Finally, in order to provide a drive for the centrifugal ejector in a simple manner, it is provided according to a preferred embodiment that the ejector wheel is connected to a drive shaft which can be coupled to an output shaft of an agricultural vehicle, in particular a tractor.

In the case of apparatuses for conveying and discharging bulk material or snow, which are designed as an attachment device for mounting on a motor vehicle, there is the problem that blockages can occur at the material front, which generally extends perpendicular to the direction of travel and from which the material is picked up by the conveying device during forward travel, especially if the material is hard or dense, which is the case, for example, with high snow conditions and/or heavy wet snow. Further forward movement of the vehicle together with the attachment is thus made more difficult or completely impossible.

In order to facilitate forward movement even in the presence of hard and/or dense material, a preferred further development provides that the apparatus for conveying and discharging bulk material or snow comprises a fixing device for fixing to a motor vehicle and the conveying device is pivotally mounted relative to the fixing device about a substantially vertical pivot axis. This allows the attachment device to pivot relative to the motor vehicle to which the attachment device is attached and which pushes the attachment device forward. The inclined position of the attachment device permits a change in the angle of the attachment device or of its conveying device relative to the material front, wherein the inclined position relative to a material front extending perpendicularly to the direction of travel results in the attachment device or the conveying device coming into engagement with the material front at the front only with the partial region displaced forwards due to the pivoting. Less force is required for partial engagement than for engagement over the entire width, so that penetration into the material and overcoming blockage situations are facilitated.

In this case, an alternating engagement of a right and a left partial region of the conveying device with the material front is extremely effective. For this purpose, the attachment device is preferably further designed in such a way that the conveying device can be pivoted in two opposite directions starting from a non-pivoted position in which the axis of rotation or the conveying direction of the conveying device is substantially perpendicular to the direction of travel of the motor vehicle. This enables pivoting both to the left and to the right.

The pivotable arrangement of the attachment device also results in improved steerability of the attachment device, whereby steering movements of the motor vehicle pushing the attachment device in front of it can be assisted.

In constructional terms, it is preferred that the conveying housing is fixed to a support which is pivotally mounted relative to the fixing device about the substantially vertical pivot axis.

Preferably, a pivot drive is provided, preferably at least one hydraulic cylinder piston unit.

Figure 5:
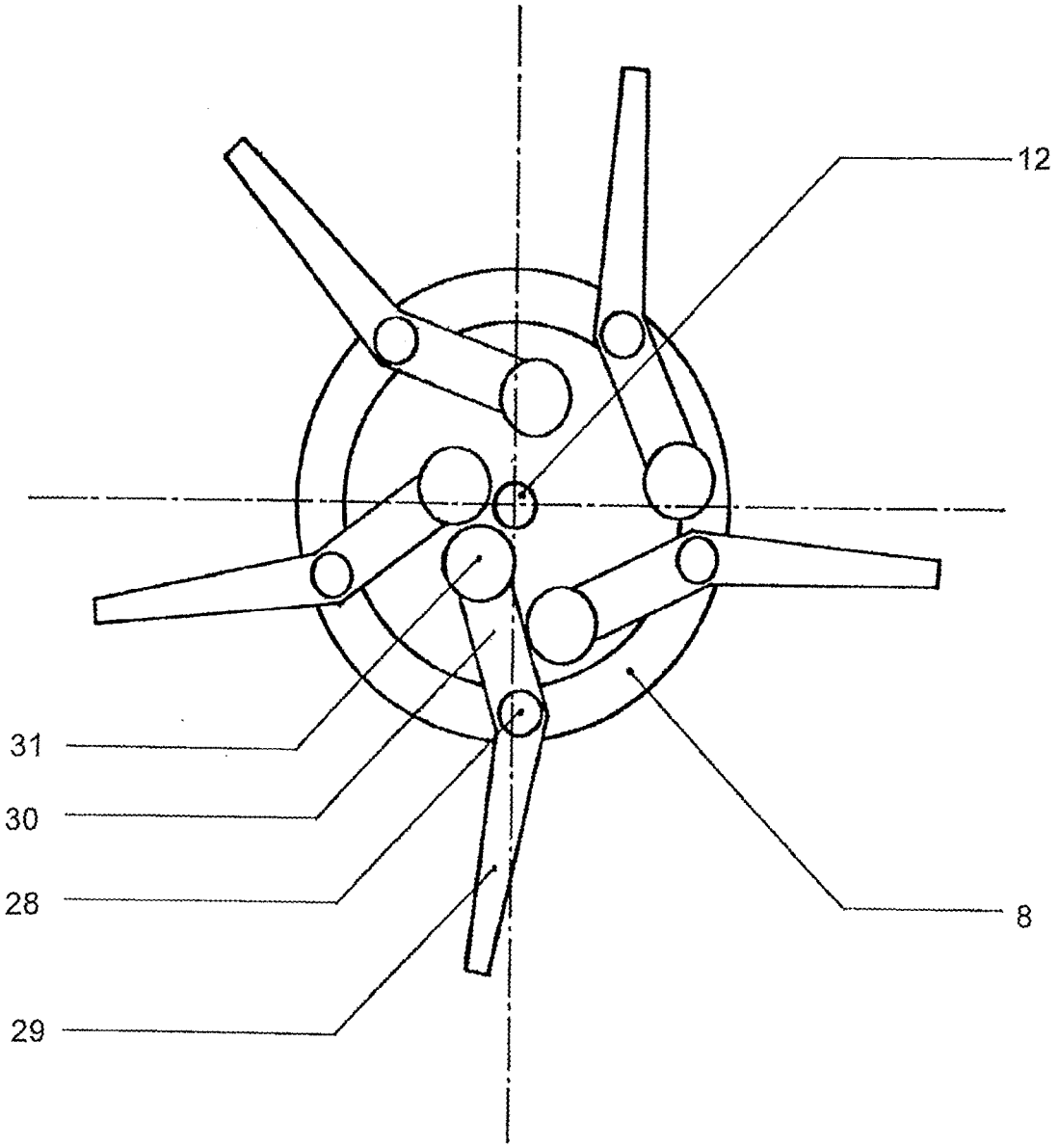
Figure 6:
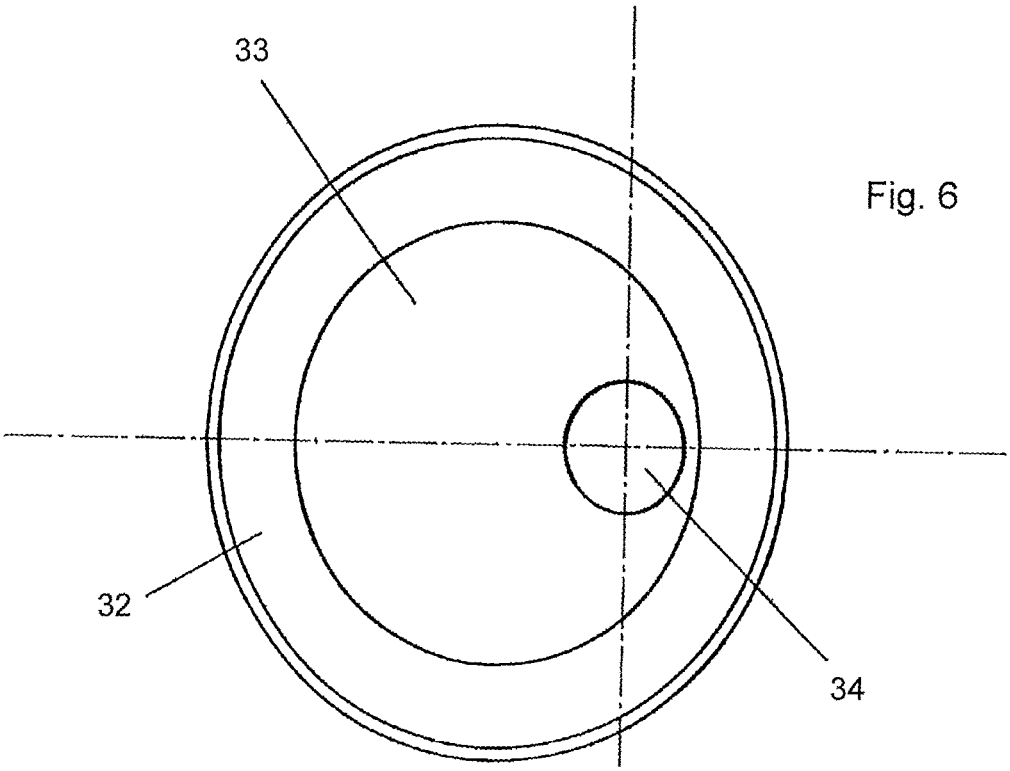
Figure 7:
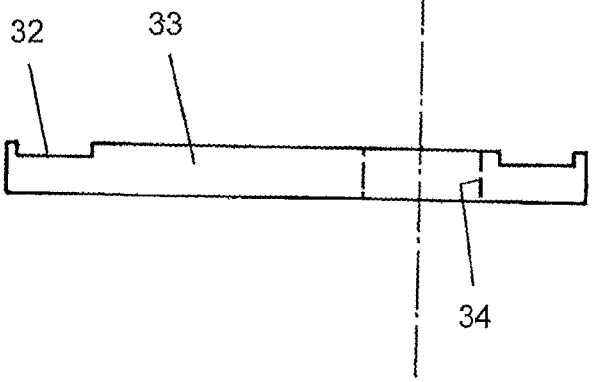

The invention is explained in more detail below with reference to an exemplary embodiment shown schematically in the drawing. In this, FIG. 1 shows a top view of an apparatus according to the invention, FIG. 2 a cross-section of the apparatus according to FIG. 1, FIG. 3 a simplified cross-sectional view in the region of the ejector wheel, FIG. 4 a cross-section through a preferred design of the centrifugal ejector, FIG. 5 a detailed view of the ejector wheel according to FIG. 4 and FIG. 6 and FIG. 7 a detailed view of the eccentric guide part.

FIG. 1 shows a tubular conveying housing 1, which is open at the bottom and optionally (in relation to the direction of travel 2) at the front. Two screw conveyors 3 and 4 are arranged in the conveying housing 1, which are rotatably driven about a tube axis 5. The screw conveyors 3, 4 are driven in opposite directions, so that the conveying direction 6 in each case runs inwards, so that the material gripped by the screw conveyors 3, 4 at the bottom and, optionally, at the front is transported to the centrifugal ejector arranged axially between the screw conveyors 3, 4. The centrifugal ejector comprises an ejector wheel 8 having a plurality of discharge levers 9, which is rotatably arranged about an axis of rotation 12 in an ejector wheel housing 11.

The conveying housing 1 is attached to a support 13, which is pivotally mounted about a substantially vertical pivot axis 14 on a bearing part 15. Hydraulic cylinder piston units 16 are provided for the controlled pivoting. The bearing part 15 has engagement elements 17 with which the entire apparatus can be attached to a corresponding connection point of a vehicle.

For driving the screw conveyors 3, 4 and the ejector wheel 8, the device comprises a drive shaft 18 which can be coupled to a power take-off of a vehicle. The transmission 19 converts the speed of the drive shaft 18 to the required speed.

Figure 2:
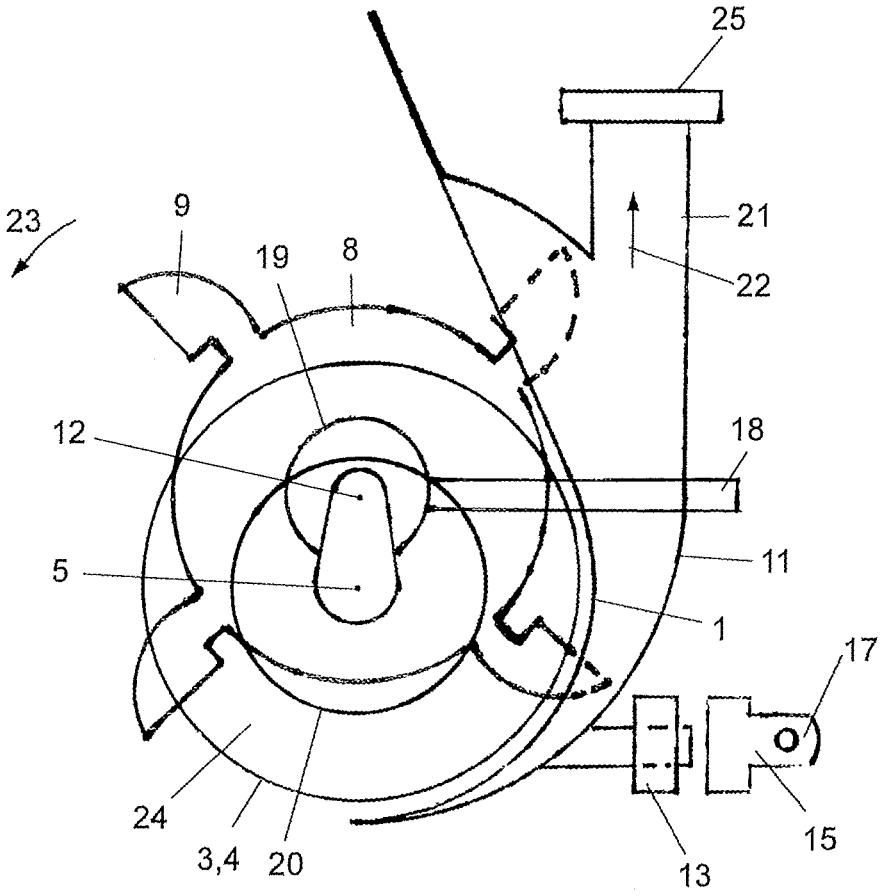

In the sectional view according to FIG. 2 it can be seen that the conveying housing 1 has a tube axis 5 which corresponds to the axis of rotation of the screw conveyors 3, 4. The screw conveyors 3, 4 here each comprise a drum 20, on the outer circumference of which there are screw-like conveyor blades 24 or the like. The ejector wheel 8 is mounted for rotation about the axis of rotation 12, wherein the direction of rotation is indicated by reference sign 23. It can be seen that the axis of rotation 12 is arranged above the tube axis 5, which is due to the different diameters of the conveying housing 1 and the ejector wheel 8 or of the enveloping circle of its discharge levers 9. However, the enveloping circle of the discharge levers 9 and the conveying housing have substantially the same horizontal or ground-parallel tangential plane.

An ejection tube 21 is tangentially connected to the ejector wheel housing 11, which has the discharge opening 25. Inside the ejector wheel housing 11, an ejection channel is formed through which the material respectively caught by the discharge levers 9 is accelerated in the circumferential direction and tangentially ejected in the direction of the arrow 22.

Figure 3:
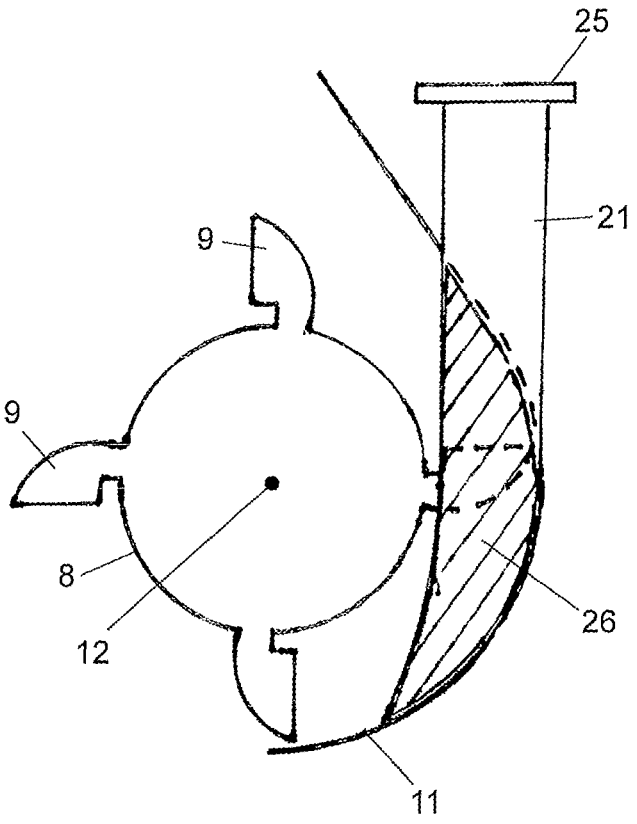

In FIG. 3, a partition wall 26 is also shown, which is arranged between each of the screw conveyors 3, 4 and the ejector wheel 8 and delimits the ejection channel on both sides, in which the discharge levers 9 are moved from the bottom upwards in the direction of the ejection tube 21.

Figure 4:
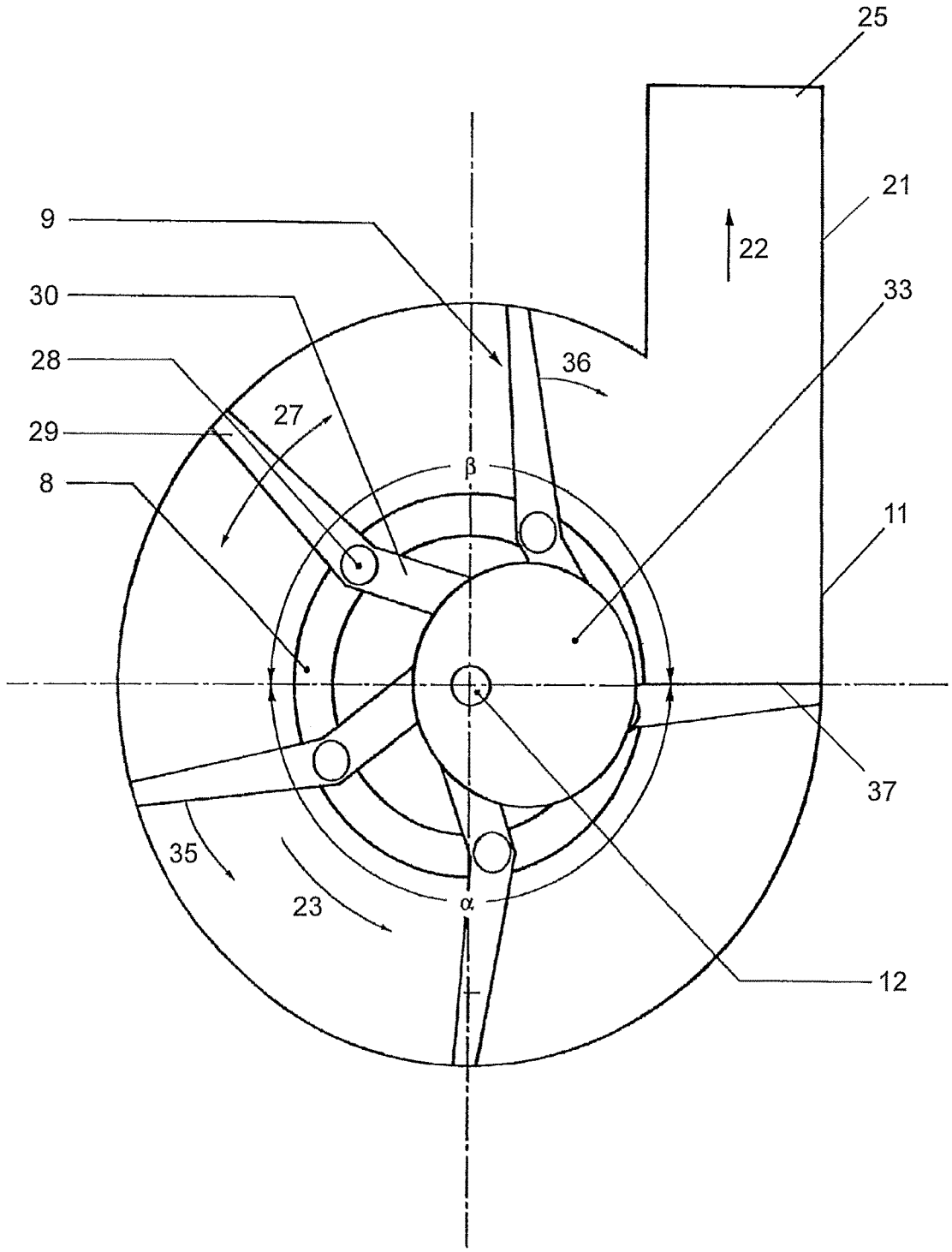

In FIG. 4, the housing of the centrifugal ejector is marked with reference sign 11, in which the ejector wheel 8 is rotatably mounted about the axis 12 in the direction of the arrow 23. The ejector wheel 8 has a plurality of discharge levers 9, each of which is hinged to the ejector wheel 8 so as to be pivotable about an axis 28 in accordance with the double arrow 27. The discharge levers 9 are designed as two-armed levers, wherein the outer lever arm 29 takes over the actual ejection work and the inwardly extending lever arm 30 has guide pins or bearings 31 in each case, as can be seen in particular in FIG. 5. The guide pins 31 are guided in a circular guide track 32 of a guide part 33, wherein the guide track 32 is arranged eccentrically with respect to the axis of rotation 2 of the ejector wheel 8. The guide part 33 has an aperture 34, which serves for the passage of a drive shaft for the ejector wheel 8. When the ejector wheel is set in rotation according to the arrow 23, the following movement of the discharge lever 9 is obtained.

Over a first angle of rotation range a, the discharge levers 9 are moved further and further forward in the direction of the arrow 35 during the rotation of the ejector wheel 8 in the direction of the arrow 23, starting from a neutral position, so that the circumferential speed of the discharge levers 9 is increased in comparison with a rigid fixing to the ejector wheel 8. The greatest circumferential speed of the discharge levers 9 results at the point designed with reference sign 37, at which the discharge of the conveyed material takes place in the direction of the arrow 22 via the discharge opening 25. Over the further angle of rotation range b, the discharge levers 9 are then pivoted back in the direction of the arrow 36, so that in this range the circumferential speed of the discharge levers 9 is reduced in comparison with a rigid fixing of the discharge levers 9 to the ejector wheel 8.

The invention claimed is:

1. An apparatus for conveying and discharging bulk material or snow, said apparatus comprising:

a conveying device having a tubular conveying housing that is partially open at a circumference and that has a conveying direction that extends substantially in a direction of a tube axis of the conveying housing; and a centrifugal ejector that adjoins the conveying device in the conveying direction and comprises an ejector wheel that has a discharge lever that is arranged in an ejector wheel housing having a discharge opening and that can be driven to rotate about an axis of rotation;

wherein the ejector wheel has a diameter, and the conveying housing has a diameter smaller than the diameter of the ejector wheel and the tube axis is arranged parallel to, and at a vertical distance below, the axis of rotation of the ejector wheel; and wherein the axis of rotation of the ejector wheel and the tube axis of the conveying housing are substantially vertically aligned.

2. The apparatus according to claim 1, wherein enveloping circles of the ejector wheel and of the conveying housing have a common tangent that extends parallel to the ground or horizontally.

3. The apparatus according to claim 1, wherein the conveying device is configured to be a conveying spiral or screw.

4. The apparatus according to claim 1, wherein the apparatus comprises at least two conveying devices each configured as a conveying spiral or screw with a conveying direction, and having a respective tubular conveying housing that is partially open at a circumference thereof, wherein each of the conveying devices is arranged on a respective side of the ejector wheel, the conveying direction of each conveying device extends substantially in the tube axis direction towards the ejector.

5. The apparatus according to claim 1, wherein the discharge lever is pivotably fixed to the ejector wheel and has a pivot angle of the discharge lever that varies as a function of an angle of rotation of the ejector wheel.

6. The apparatus according to claim 5, wherein the pivoting of the discharge lever in a direction of rotation of the ejector wheel via a first angle of rotation range effectuates pivoting of the discharge lever counter to the direction of rotation of the ejector wheel in a further angle of rotation range.

7. The apparatus according to claim 6, wherein the discharge opening is tangentially connected to the ejector wheel at an end of the first rotation angle range.

8. The apparatus according to claim 5, wherein the discharge lever is a two-armed lever, wherein an inwardly extending lever arm thereof cooperates with a positive guide.

9. The apparatus according to claim 8, wherein the positive guide comprises a guide track cooperating with a guide pin of the lever arm.

10. The apparatus according to claim 9, wherein the guide track extends eccentrically with respect to the axis of rotation of the ejector wheel.

11. The apparatus according to claim 1, wherein the ejector wheel is connected to a drive shaft that is configured to be coupled to an output shaft of an agricultural vehicle or a tractor.

12. A snow blower comprising the apparatus according to claim 1.

* * * * *